US009815677B2

(12) United States Patent
Lassen

(10) Patent No.: US 9,815,677 B2
(45) Date of Patent: Nov. 14, 2017

(54) DISPENSING LINE FOR A DISPENSING SYSTEM

(71) Applicant: MICRO MATIC A/S, Odense SV (DK)

(72) Inventor: Thomas Lassen, Odense S (DK)

(73) Assignee: MICRO MATIC A/S, Odense SV (DK)

( * ) Notice: Subject to any disclaimer, the term of this patent is extended or adjusted under 35 U.S.C. 154(b) by 713 days.

(21) Appl. No.: 13/954,083

(22) Filed: Jul. 30, 2013

(65) Prior Publication Data

US 2013/0313290 A1 Nov. 28, 2013

Related U.S. Application Data

(63) Continuation of application No. 11/574,764, filed on Sep. 17, 2007, now abandoned.

(30) Foreign Application Priority Data

Sep. 13, 2004 (DK) ..... 2004 01388
Nov. 9, 2004 (DK) ..... 2004 01725
Sep. 9, 2005 (WO) ..... PCT/DK2005/000577

(51) Int. Cl.
*B65D 83/00* (2006.01)
*B67D 1/08* (2006.01)
*B67D 1/04* (2006.01)

(52) U.S. Cl.
CPC ..... *B67D 1/0841* (2013.01); *B67D 1/0412* (2013.01); *B67D 1/0829* (2013.01); *B67D 2210/00028* (2013.01)

(58) Field of Classification Search
CPC ... B67D 1/0845; B67D 1/0847; B67D 1/0848
USPC ..... 222/147, 153.01, 153.05, 153.06, 399, 222/400.7, 400.8
See application file for complete search history.

(56) References Cited

U.S. PATENT DOCUMENTS 4,045,525 A 8/1977 Huggins
4,402,429 A * 9/1983 Vanden Driessche ... 222/153.01
4,834,266 A 5/1989 Brewer et al.
5,609,272 A 3/1997 Brass et al.
6,105,825 A 8/2000 Gomi et al.
(Continued)

FOREIGN PATENT DOCUMENTS

GB 2204027 11/1988
WO WO 88/03901 6/1988
(Continued)

*Primary Examiner* — Jeremy W Carroll
(74) *Attorney, Agent, or Firm* — Nixon & Vanderhye P.C.

(57) ABSTRACT

The present invention relates to a dispensing line for a dispensing system to be used in connection with dispensing of a beverage. Said system comprising a beverage container, said container comprising an outlet wherein an extractor tube is arranged, and a dispensing device adapted to connect a pressure medium, such as $CO_2$, to the container so that the beverage present in the container is forced out of the container via the extractor tube. The dispensing line further comprises a connection means for attachment to the extractor tube, said connection means comprises a non-reattachment means, which is adapted to disengage the connection when the dispensing line is detached from the extractor tube, so that the dispensing line cannot be reused.

11 Claims, 7 Drawing Sheets

(56) References Cited

U.S. PATENT DOCUMENTS

| | | | |
|---|---|---|---|
| 6,820,775 | B2 | 11/2004 | Meike et al. |
| 6,942,127 | B2 | 9/2005 | Raats |
| 7,188,751 | B2 | 3/2007 | Van Der Kiaauw et al. |
| 2004/0035884 | A1 | 2/2004 | De La Guardia |
| 2008/0142553 | A1 | 6/2008 | Lassen |

FOREIGN PATENT DOCUMENTS

| | | |
|---|---|---|
| WO | WO 00/03944 | 1/2000 |
| WO | WO 2004/050535 | 6/2004 |

* cited by examiner

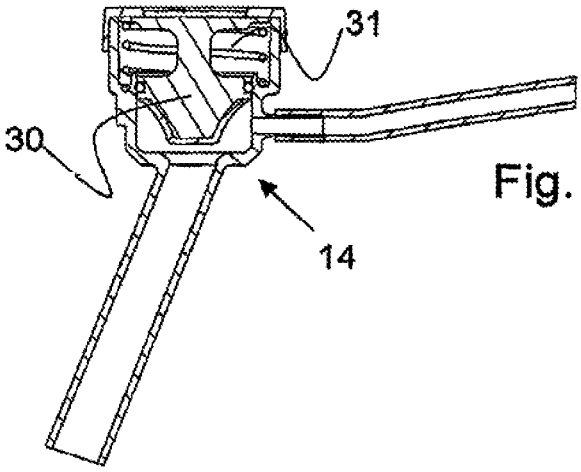
Fig. 9
Fig. 10
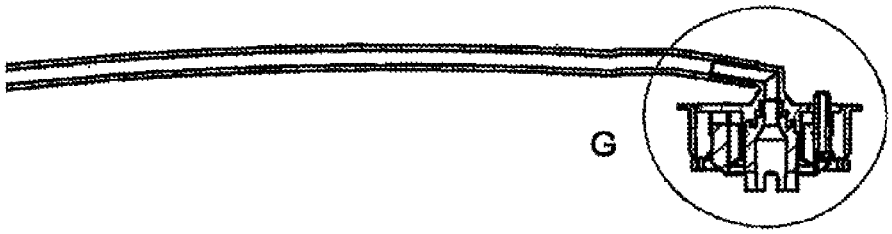
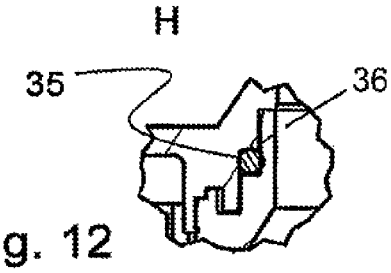
Fig. 12
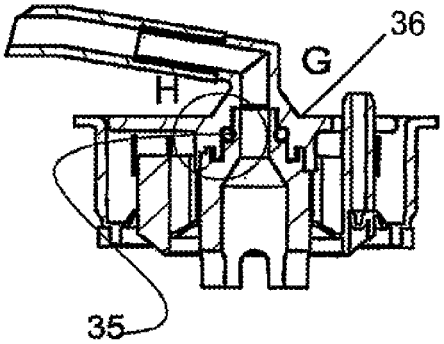
Fig. 11

DISPENSING LINE FOR A DISPENSING SYSTEM

CROSS REFERENCE TO RELATED APPLICATION

This is a continuation of U.S. application Ser. No. 11/574,764, filed Sep. 17, 2007, which claims priority to International Application No. PCT/DK2005/000577, filed Sep. 9, 2005 and Danish Application Nos. 200401388, filed Sep. 13, 2004 and 200401725, filed Nov. 9, 2004, each incorporated herein by reference in its entirety.

FIELD OF THE INVENTION

The present invention relates to a dispensing line for a dispensing system to be used in connection with dispensing of a beverage. Said system comprising a beverage container, said container comprising an outlet wherein an extractor tube is arranged, and a dispensing device adapted to connect a pressure medium, such as $CO_2$, to the container so that the beverage present in the container is forced out of the container via the extractor tube.

The present invention furthermore relates to a system for dispensing of a beverage, an extractor tube as well as use of said dispensing line.

BACKGROUND ART

Dispensing of beverage, such as beer, has become more in focus of the consumer due to the fact that the consumer of the beer has become increasingly more aware of the quality of the beer and tend to chooses the beer label from the view of the final impression, i.e. the dispensed beer.

The impression of a newly dispensed beer is influenced by the taste and how it appears to the consumer. Also the taste of the beer may change as the temperature of the beer vary. In view of this, it is of high importance that the dispensing devices serve the purpose of dispensing beer at only the right temperature range and also at the right amount of $CO_2$ in the beer.

The amount of $CO_2$ in a newly dispensed beer is influenced by the amount of $CO_2$ applied to the beer at the time of manufacture and under which circumstance the beer has been stored. The amount of $CO_2$ applied to the beer will migrate out of the beer if the beer is not kept under pressure in the beer keg. Therefore, it is very important that the pressure of the $CO_2$ besides being sufficient for dispensing the beer also is sufficient to keep pressure balance in the beer keg and thereby keep the beer fizzy and foamy after dispensing.

Furthermore, the beer dispensing devices have become in the reach of more consumers to have in their homes, in their firms, at the sports facility etc., where no trained personal is operating the dispensing devices. Thus, the safety of the user of the dispensing device and the hygiene of the device has likewise become very important.

When dispensing beverage, such as beer, in a bar facility it may sometimes be of difficulty for the personal to clean the device properly or it might just be given a low priority in the daily routines.

Furthermore, often during replacement of the beverage container, the dispensing line is being reused without being cleaned. The consequence is that the dispensing line may contain old beverage and that for instance bacteria is present. This may provide a bad taste to the beverage or even in some instances health disadvantages for the consumer.

Thus, there is a need of an easily operated dispensing system and a dispensing line, which still observes and fulfils the hygiene and safety regulations fixed by law.

SUMMERY OF THE INVENTION

An object of the present invention is to wholly or partly overcome the above disadvantages and drawbacks of the prior art. More specifically, it is an object to provide a dispensing line which enables an essentially non-cleaning system.

Additionally, an object of the present invention is to facilitate the work necessary for keeping the dispensing device substantially clean and thereby increase the hygiene of the dispensing device.

An object of the present invention is to provide an dispensing line which is easy to use in relation to mounting and dismounting of the line to the dispensing system and to the extractor tube as well as to replacing the beverage container when this is empty.

Furthermore, an object of the present invention is to provide a dispensing line wherein a security arrangement is build-in, which enables that the dispensing line only may be used one time.

It is also an object of the present invention to provide a dispensing line which is inexpensive.

The above objects, together with numerous other objects, advantages and features, which will become evident from the below description, are accomplished by a solution in accordance with the present invention by the dispensing line comprises a connection means for attachment to the extractor tube, said connection means comprises a non-reattachment means, which is adapted to disengage the connection when the dispensing line is detached from the extractor tube, so that the dispensing line cannot be reused.

Hereby is obtained that the dispensing line only may be used one time. Furthermore, the cleaning operation of the dispensing device mentioned above is then no longer necessary due to the inventive dispensing line. This dispensing line is used only once, i.e. only to one beverage container, and the beverage is only in contact with the inside of the dispensing line when dispensed from the container to e.g. a drinking glass.

Also, when using the one and the same dispensing device for different labels of beverages or different beverages types, the dispensing line may be used as one dispensing line for each beverages without cleaning the dispensing line as well as the dispensing device between the change in beverages.

During operation of the dispensing line according to the invention the non-reattachment means of the connection means is adapted to disengage the connection to the extractor tube when the dispensing line is detached from the extractor tube, so that the dispensing line cannot be reused. This ensures that the dispensing line cannot be reused when changing the beverage container and that proper hygiene of the dispensing line as well as the dispensing device and system is maintained.

The term "reused" is in this context to be construed as the dispensing line, after detachment from the extractor tube, cannot be reused without prior modification of the connection means (i.e. the non-reattachment means) and cleaning.

According to a preferred embodiment of the invention the non-reattachment means may comprise sealing means which is adapted to lose its sealing property when the connection means is detached from the extractor tube. When the sealing means (during the detachment) is lost or destroyed, the dispensing line cannot be reused since the connection to the ex-tractor tube will be leaky. The matter is that the connection means not will fit the extractor tube after the detachment wherefore the pressure medium not properly will be connected to the extractor tube, thus, the extractor tube will not function.

Advantageously, the connection means may be attached to the extractor tube by a snap or click action. Hereby is obtained an easy and fast method to attach the dispensing line to the extractor tube.

Additionally, the non-reattachment means may comprise means for destroying or damaging the snap or click action when the connection means is detached from the extractor tube. The matter is that after the detachment the snap or click action is lost or destroyed wherefore the connection means not can be attached to the extractor tube again. It will simply not be secured to the extractor tube with the consequence that the dispensing system not will function as the pressure medium not will be led properly to the extractor tube.

The connection means according to the invention may comprise a valve which is adapted to connect the pressure medium to the extractor tube.

In a particular embodiment of the invention the dispensing line may be made of a flexible material, such as plastic or the like, whereby the dispensing line is easy to handle during mounting and dismounting.

Furthermore, the connection means may advantageously be made of a material, which is mouldable such as polymer. Hereby is obtained that the connection means may be manufactured by, for instance, die casting.

In expedient manner the dispensing line may be disposable or an one-way part.

According to the invention the dispensing line may be sterile packed.

In an embodiment according to the invention the dispensing line may comprise an outlet which is the outlet of the device. The fact that this outlet is the outlet of the device ensures that the dispensing device has no direct contact with the beverage. This ensures that the dispensing line alone has contact with the beverage and that a cleaning operation is no longer necessary when the dispensing line is changed during the replacement of the beverage container.

The outlet may be tapered towards the opening for enhancing the flow properties of the beverage at the outlet.

Furthermore, the part of the dispensing line located closest to the outlet may be angled so as to provide a non-dripping outlet.

Moreover, the dispensing line may comprise means which is connected to a handle for opening and closing the dispensing line.

The invention further relates to an extractor tube, a dispensing system as well as to an use of the dispensing line as stated in the attached claims.

BRIEF DESCRIPTION OF THE DRAWINGS

The invention and its many advantages will be described in more detail below with reference to the accompanying schematic drawings, which for the purpose of illustration show some non-limiting embodiments and in which FIG. 9 shows a second embodiment of a part of the dispensing line, FIG. 10 shows a cross-section of a second embodiment of a part of the disposable dispensing line, FIG. 11 shows an enlarged section of the cross-section of the dispensing line shown in FIG. 10, FIG. 12 shows an enlarged section of the encircled area H shown in FIG. 11.

DESCRIPTION OF PREFERRED EMBODIMENTS

Figure 1:
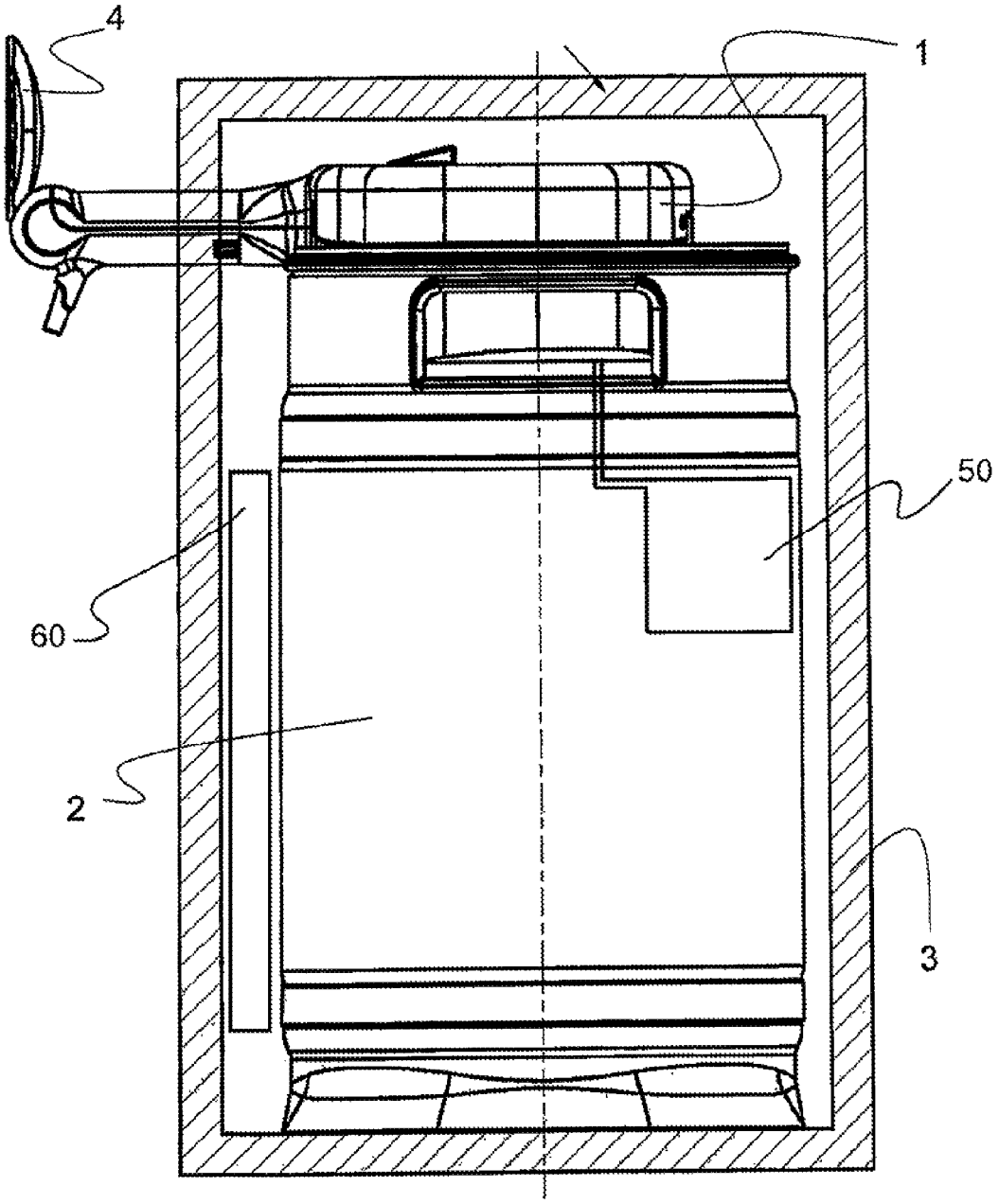
FIG. 1 shows a dispensing device placed on top of a beer keg.

In FIG. 1 the dispensing device 1 is shown schematic, mounted on a beverage container 2, here in the form of a beer keg 2, inside a housing 3 where only a handle 4 for dispensing the beverage as well as the outlet of the dispensing device is projecting out from the housing 3. Inside the housing 3 the beer keg 2 may be cooled by use of a cooling device 60.

Figure 2:
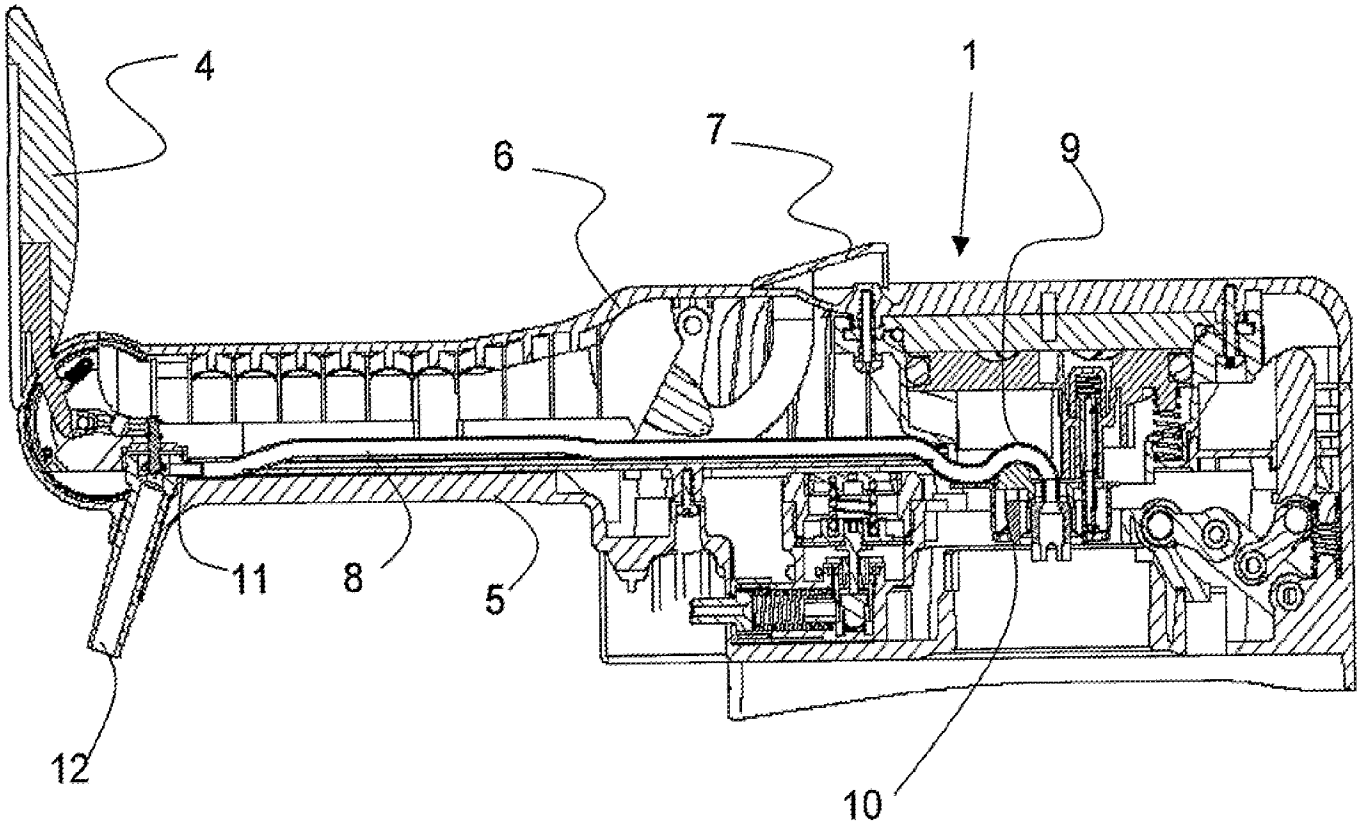
FIG. 2 shows in a side view a cross section of the dispensing device.

In FIG. 2 is the dispensing device 1 schematically shown in cross section. In the dispensing device 1 several different properties may be incorporated such as for instance pressure regulation means, different security arrangement for avoiding damage on the user as well as on the dispensing device during unintended handling, valve means etc.

In this embodiment the device consists of two parts, a first bottom part 5 and a second top part 6, the top part 6 functions also as a lid. The dispensing device may be opened by pressing the release means 7 whereby the lid 6 may be lifted so that the interior of the dispensing device 1 is laid open.

Hereby, there will be access to the dispensing line 8 according to the present invention. The dispensing line will be described in detail in connection with FIGS. 3-6 below. However, in FIG. 2 the extension of the dispensing line 8 through the dispensing device 1 is shown. In one end 9 of the dispensing line 8 a connection means 10 is arranged for attaching the dispensing line 8 to the extractor tube (not shown) and thereby the beverage contained in the container (not shown). In the opposite end 11 of the connection means the outlet 12 of the dispensing line 8 is provided.

Figure 3:
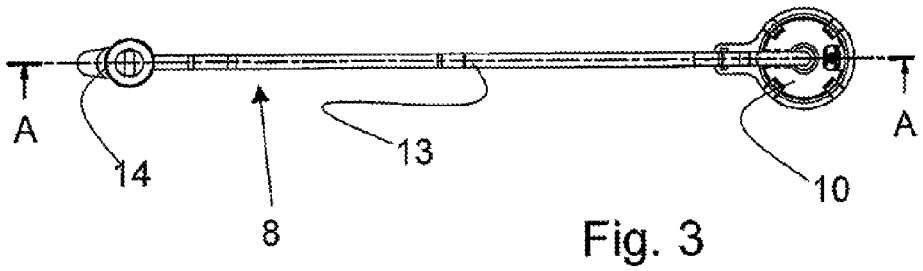
FIG. 3 shows a view of the dispensing line according to the invention seen from above.
Figure 4:
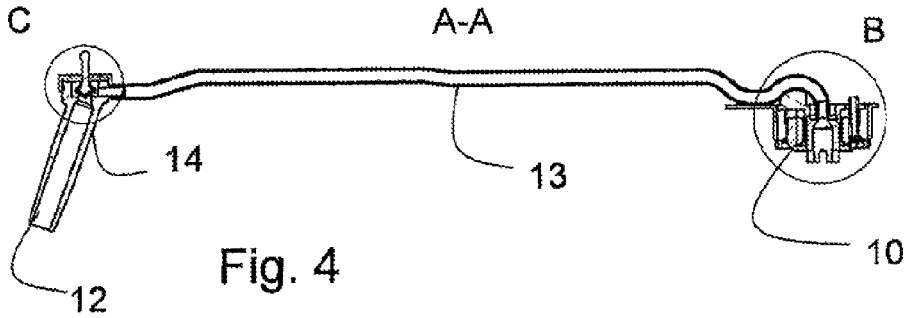
FIG. 4 shows a cross-section of the disposable dispensing line shown in FIG. 3.

In FIG. 3 the dispensing line 8 is seen from above and in cross-section in FIG. 4. The dispensing line 8 comprises a connection part 10, a tube part 13 and a dispensing part 14, i.e. the outlet 12. The connection part 10 is adapted to be arranged in connection with the extractor tube (not shown) so as to provide a hermetical connection for dispensing beverage. The dispensing part 14 is arranged in connection with the handle 4 of the dispensing device 1 so to engage with the handle to open and close the dispensing of beverage.

Figure 5:
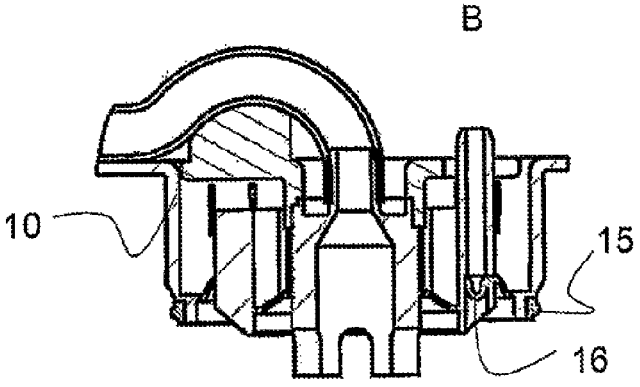
FIG. 5 shows an enlarged section of the cross-section of the dispensing line shown in FIG. 4.

An enlarged area B of the connecting part 10 is shown in FIG. 5 in which the cross-section of the sealing means 15 can be seen. These sealing means 15 enables hermetically connection to the extractor tube (not shown), and which sealing means or non-reattachment means either is detached, broken off or destroyed when detaching the connecting part 10 from the extractor tube. It is hereby secured that the dispensing line 8 is for one single use only, i.e. the dispensing line 8 may be disposable or even a one-way part.

In FIGS. 10-12 is shown another embodiment of the sealing means 35, i.e. the non-reattachment means.

Furthermore, the connection means 10 may comprise a valve 16 which is adapted to connect the pressure medium to the extractor tube.

Figure 6:
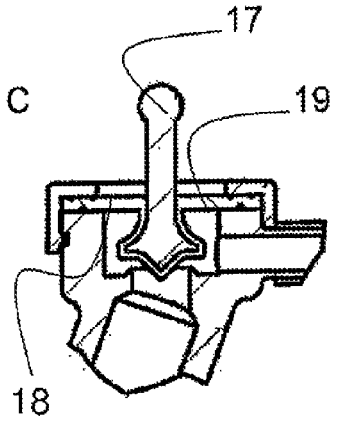
FIG. 6 shows an enlarged section of the cross-section of the dispensing line shown in FIG. 4.

In FIG. 6 an enlarged area C of the dispensing part 14 is shown. The dispensing of beverage is carried out, as previously mentioned, by pulling the handle 4 of the dispensing device 1. This handle 4 is engaging the catch 17 of the dispensing part of the dispensing line 8 to open and close the dispensing of beverage. The catch 17 is in this embodiment covered with a sealing layer 18, 19 which extends further along a part of the dispensing part. The catch 17 as seen in FIG. 6 has neutrally open position, and when engaging with the handle 4 is forced more open or forced to close the dispensing of beverage. When the catch 17 is closing the dispensing of the beverage the sealing means ensures a hermetically closure.

In FIG. 9 another embodiment of the dispensing part 14 is shown in cross-section. The dispensing part 14 comprises in this embodiment a plug 30 and a spring 31, such as a helically spring. The spring 31 is adapted to provide the plug with a force in a direction away from the dispensing line. During operation the spring 31 will provide an open dispensing line until the plug is being forced down towards the dispensing line due to the top part of the device is being closed. Hereinafter the plug 31 may be activated by the handle as explained above, thereby enabling dispensing of the beverage from the container.

The dispensing line 8 further comprises an outlet 12 which in this embodiment is the outlet of the dispensing device so as to ensure that the dispensing device 1 has no contact with the beverage. The fact that the dispensing line 8 is the only means which has contact with the beverage in the device and that the non-reattachment means renders the reuse of the dispensing line 8 impossible, it is ensured that a high hygiene is present in the dispensing device also after replacing of the beverage container.

The dispensing line 8 may advantageously be made of plastic but may as well be made of other flexible materials which enables a passage of beverage. A further advantage is that the dispensing line is inexpensive.

According to the invention the outlet 12 may be tapered (not shown) towards the opening for enhancing the flow properties of the beverage at the outlet. Furthermore, the part of the dispensing line 8 located closest to the outlet 12 is angled so as to provide a non-dripping outlet as shown in FIG. 4.

Figure 13:
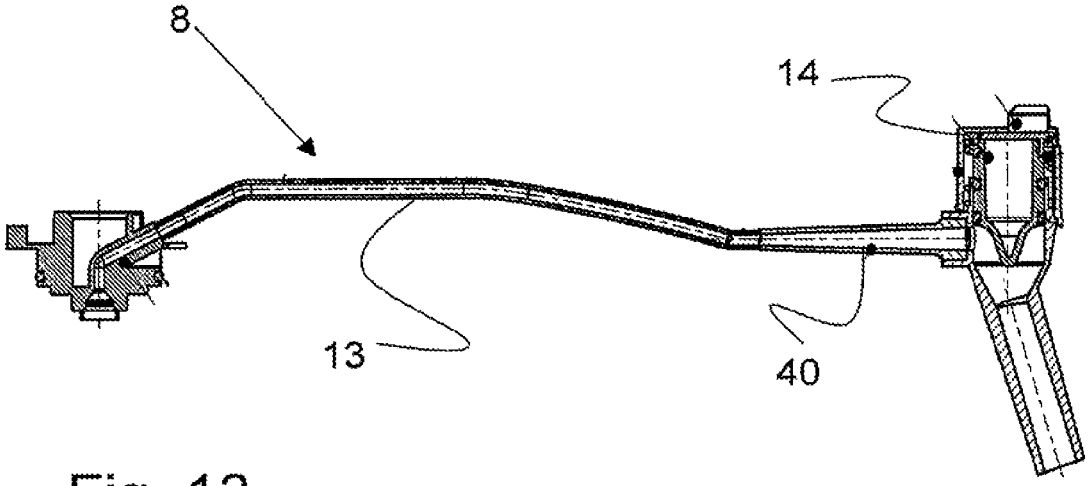
FIG. 13 shows another embodiment of the dispensing line.

In FIG. 13 is another embodiment of the dispensing line 8 shown. In this embodiment a section 40 is arranged between the tube part 13 and the dispensing part 14. The section 40 is a conical-shaped tube or channel, having its smallest inner diameter near the tube part 13. By using this section 40 in the dispensing line 8 it is obtained that the flow rate of the beverage being dispensed is decreased before entering the dispensing part 14, whereby a more calm dispensing is obtained and undesirable foam-formation in beverage is avoided. The section 40 may be an integrated part of the dispensing part 14 or it may be a separate part which is assembled before use. Preferably, the section 40 is made of a plastic material.

As mentioned above the beverages are today kept in and dispensed from containers pressurized by a propelling gas. For this objective each container is provided with a valve arrangement, i.e. an extractor tube 20 with two passages, one for gas inlet and one for pressing the beverage out of the container by the gas pressure. The extractor tube 20, is normally arranged into a neck secured in the outlet opening in the container.

Figure 7:
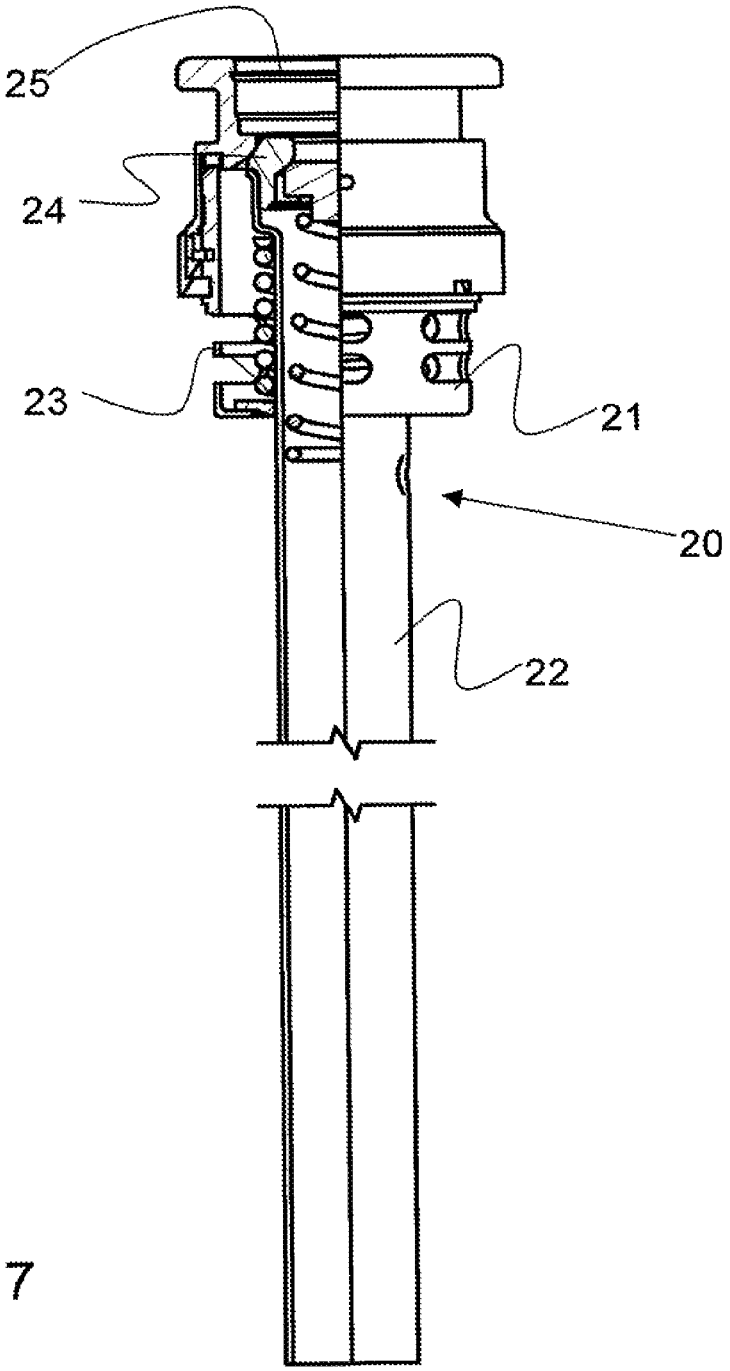
FIG. 7 shows a view of the extractor tube according to the present invention.
Figure 8:
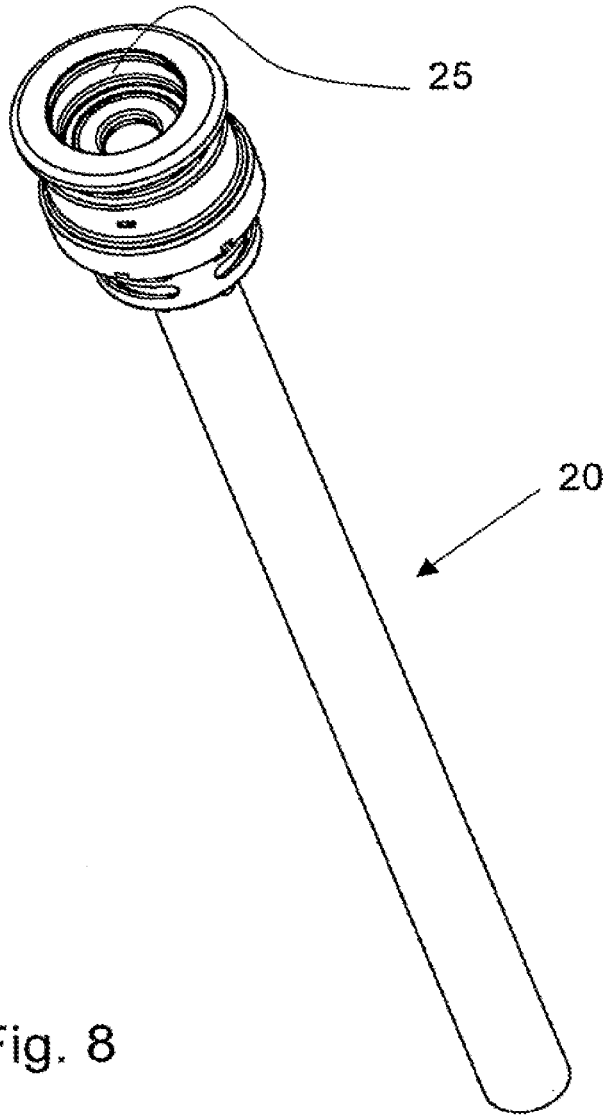
FIG. 8 shows a perspective of the extractor tube shown in FIG. 7.

FIGS. 7 and 8 shows the extractor tube 20 according to the invention. In FIG. 7 the extractor tube 20 is shown partly in sectional view. The extractor tube 20 comprises a skirt 21 surrounding the down tube 22. Furthermore, an external pressure spring 23 is arranged around the down tube 22 inside the skirt 21. At its upper end the pressure spring 23 abuts a conical extension of the down tube 22, which again abuts a sealing element 24. In this embodiment the pressure spring 23 is shown as a helical spring. At the top of the extractor tube 20 comprises attachment means which is adapted to be connectable with the connection means of the dispensing line. Advantageously, the top of the extractor tube 20 is extended relative to the conventionally extractor tubes for facilitating the connection between the dispensing line and the extractor tube.

In FIG. 8 is shown a perspective view of the extractor tube 20 according to the invention. From this figure the attachment means 25 is clearly shown.

Assembling of a preferred dispensing system for dispensing of beverage is carried out by fitting the dispensing device, i.e. the coupling device, on top of the extractor tube. Subsequently, the disposable dispensing line is then fitted into the dispensing device and onto the extractor tube, for instance by way of snap or click attachment 36. Finally, the device is closed whereby a connection to the pressure medium is executed, which pressure medium exe-cutes the double functional valve by forcing the piston downwards for opening of passage of beverage of the extractor tube. Hereby, the beverage is dispensable by activating the handle of the device.

When replacing the beverage container the dispensing device is opened by opening the lid. This opening action shuts off the pressure medium and the confined pressure is then released through the safety means. Hereinafter, the dispensing line is detached from the extractor tube. During this detachment the connection means of the dispensing line is damaged so that it not is able to be reused in connection with another extractor tube or container. Accordingly, it is secured that the dispensing line is replaced every time the container is changed, whereby a high hygiene of the device is obtained. Subsequently, the dispensing device is detached from the extractor tube and afterwards the device may be used to another container.

The present invention furthermore relates to a system for dispensing beverage. The dispensing system comprises a beverage container comprising an outlet wherein an extractor tube is arranged, and a dispensing device adapted to connect a pressure medium, such as $CO_2$, to the container so that the beverage present in the container is forced out of the container via the extractor tube. Said system further comprises a dispensing line according to the inventive idea.

Advantageously, the pressure medium may be contained in a separate compartment 50 in the container. Furthermore, the container may be made of metal and a cooling device 60 may be arranged in contact with the container so that the container is cooled by this contact.

Although the invention above has been described in connection with preferred embodiments of the invention, it will be evident for a person skilled in the art that several modifications are conceivable without departing from the invention as defined by the following claims.

The invention claimed is:

1. A dispensing line for a dispensing system to be used in connection with dispensing of a beverage, said system comprising a beverage container, said container comprising an outlet wherein an extractor tube is arranged, and a dispensing device adapted to connect a pressure medium to the container so that the beverage present in the container is forced out of the container via the extractor tube, said dispensing line comprising:

a flow passage adapted to be in contact with the beverage when the beverage is being dispensed and adapted to be in fluid communication with the extractor tube; and a connection device adapted to attach to the extractor tube, wherein said connection device comprises a non-reattachment device that is adapted to disengage the connection device when the dispensing line is detached from the extractor tube so that the dispensing line cannot be reused, wherein the non-reattachment device comprises a seal which is adapted to lose its sealing property when the connection device is detached from the extractor tube.

2. A dispensing line for a dispensing system to be used in connection with dispensing of a beverage, said system comprising a beverage container, said container comprising an outlet wherein an extractor tube is arranged, and a dispensing device adapted to connect a pressure medium to the container so that the beverage present in the container is forced out of the container via the extractor tube, said dispensing line comprising:

a flow passage adapted to be in contact with the beverage when the beverage is being dispensed and adapted to be in fluid communication with the extractor tube; and a connection device adapted to attach to the extractor tube, wherein said connection device comprises a non-reattachment device that is adapted to disengage the connection device when the dispensing line is detached from the extractor tube so that the dispensing line cannot be reused, wherein the connection device comprises a valve which is adapted to connect the pressure medium to the extractor tube.

3. A dispensing line for a dispensing system to be used in connection with dispensing of a beverage, said system comprising a beverage container, said container comprising an outlet wherein an extractor tube is arranged, and a dispensing device adapted to connect a pressure medium to the container so that the beverage present in the container is forced out of the container via the extractor tube, said dispensing line comprising:

a flow passage adapted to be in contact with the beverage when the beverage is being dispensed and adapted to be in fluid communication with the extractor tube; and a connection device adapted to attach to the extractor tube, wherein said connection device comprises a non-reattachment device that is adapted to disengage the connection device when the dispensing line is detached from the extractor tube so that the dispensing line cannot be reused, wherein the dispensing line is made of a flexible material.

4. A dispensing line for a dispensing system to be used in connection with dispensing of a beverage, said system comprising a beverage container, said container comprising an outlet wherein an extractor tube is arranged, and a dispensing device adapted to connect a pressure medium to the container so that the beverage present in the container is forced out of the container via the extractor tube, said dispensing line comprising:

a flow passage adapted to be in contact with the beverage when the beverage is being dispensed and adapted to be in fluid communication with the extractor tube; and a connection device adapted to attach to the extractor tube, wherein said connection device comprises a non-reattachment device that is adapted to disengage the connection device when the dispensing line is detached from the extractor tube so that the dispensing line cannot be reused, wherein the connector device is made of a material, which is mouldable.

5. A dispensing line for a dispensing system to be used in connection with dispensing of a beverage, said system comprising a beverage container, said container comprising an outlet wherein an extractor tube is arranged, and a dispensing device adapted to connect a pressure medium to the container so that the beverage present in the container is forced out of the container via the extractor tube, said dispensing line comprising:

a flow passage adapted to be in contact with the beverage when the beverage is being dispensed and adapted to be in fluid communication with the extractor tube; and a connection device adapted to attach to the extractor tube, wherein said connection device comprises a non-reattachment device that is adapted to disengage the connection device when the dispensing line is detached from the extractor tube so that the dispensing line cannot be reused, wherein the dispensing line is disposable or an one-way part.

6. A dispensing line for a dispensing system to be used in connection with dispensing of a beverage, said system comprising a beverage container, said container comprising an outlet wherein an extractor tube is arranged, and a dispensing device adapted to connect a pressure medium to the container so that the beverage present in the container is forced out of the container via the extractor tube, said dispensing line comprising:

a flow passage adapted to be in contact with the beverage when the beverage is being dispensed and adapted to be in fluid communication with the extractor tube; and a connection device adapted to attach to the extractor tube, wherein said connection device comprises a non-reattachment device that is adapted to disengage the connection device when the dispensing line is detached from the extractor tube so that the dispensing line cannot be reused, wherein the dispensing line is sterile packed.

7. A dispensing line for a dispensing system to be used in connection with dispensing of a beverage, said system comprising a beverage container, said container comprising an outlet wherein an extractor tube is arranged, and a dispensing device adapted to connect a pressure medium to the container so that the beverage present in the container is forced out of the container via the extractor tube, said dispensing line comprising:

a flow passage adapted to be in contact with the beverage when the beverage is being dispensed and adapted to be in fluid communication with the extractor tube; and a connection device adapted to attach to the extractor tube, wherein said connection device comprises a non-reattachment device that is adapted to disengage the connection device when the dispensing line is detached from the extractor tube so that the dispensing line cannot be reused, wherein the dispensing line comprises an outlet which is the outlet of the device and the outlet is tapered towards an opening for enhancing the flow properties of the beverage at the outlet.

8. A dispensing line for a dispensing system to be used in connection with dispensing of a beverage, said system comprising a beverage container, said container comprising an outlet wherein an extractor tube is arranged, and a dispensing device adapted to connect a pressure medium to the container so that the beverage present in the container is forced out of the container via the extractor tube, said dispensing line comprising:

a flow passage adapted to be in contact with the beverage when the beverage is being dispensed and adapted to be in fluid communication with the extractor tube; and a connection device adapted to attach to the extractor tube, wherein said connection device comprises a non-reattachment device that is adapted to disengage the connection device when the dispensing line is detached from the extractor tube so that the dispensing line cannot be reused, wherein the dispensing line comprises an outlet which is the outlet of the device and the part of the dispensing line located closest to the outlet is angled so as to provide a non-dripping outlet.

9. A dispensing line for a dispensing system to be used in connection with dispensing of a beverage, said system comprising a beverage container, said container comprising an outlet wherein an extractor tube is arranged, and a dispensing device adapted to connect a pressure medium to the container so that the beverage present in the container is forced out of the container via the extractor tube, said dispensing line comprising:

a flow passage adapted to be in contact with the beverage when the beverage is being dispensed and adapted to be in fluid communication with the extractor tube; and a connection device adapted to attach to the extractor tube, wherein said connection device comprises a non-reattachment device that is adapted to disengage the connection device when the dispensing line is detached from the extractor tube so that the dispensing line cannot be reused, wherein the dispensing line comprises a closure which is connected to a handle and is adapted to open and close the dispensing line.

10. A system for dispensing beverage, comprising:

a beverage container, said container comprising an outlet wherein an extractor tube is arranged, a dispensing device adapted to connect a pressure medium to the extractor tube so that the beverage present in the container is forced out of the container via the extractor tube, a dispensing line comprising a flow passage adapted to be in contact with the beverage when the beverage is being dispensed and adapted to be in fluid communication with the extractor tube, and a connection device attached to the extractor tube, said connection device comprising a non-reattachment device, which is adapted to disengage the connection device when the dispensing line is detached from the extractor tube, so that the dispensing line cannot be reused, wherein the dispensing device is adapted for reuse.

11. A system for dispensing beverage, comprising:

a beverage container, said container comprising an outlet wherein an extractor tube is arranged, a dispensing device adapted to connect a pressure medium to the extractor tube so that the beverage present in the container is forced out of the container via the extractor tube, a dispensing line comprising a flow passage adapted to be in contact with the beverage when the beverage is being dispensed and adapted to be in fluid communication with the extractor tube, and a connection device attached to the extractor tube, said connection device comprising a non-reattachment device, which is adapted to disengage the connection device when the dispensing line is detached from the extractor tube, so that the dispensing line cannot be reused, wherein the dispensing line is a replaceable component of the dispensing device.

* * * * *